US006241003B1

(12) United States Patent
Kodama et al.

(10) Patent No.: US 6,241,003 B1
(45) Date of Patent: Jun. 5, 2001

(54) INJECTION CONTROL METHOD AND DEVICE OF DIE-CASTING MACHINE

(75) Inventors: Shinobu Kodama, Zama; Makoto Tsuji, Yamato, both of (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/432,256

(22) Filed: Nov. 2, 1999

(30) Foreign Application Priority Data

Nov. 2, 1998 (JP) ..... 10-311949

(51) Int. Cl.[7] ..... B22D 17/32

(52) U.S. Cl. ..... 164/457; 164/155.1; 164/315; 164/113

(58) Field of Search ..... 164/113, 119, 164/120, 457, 155.3, 155.4, 155.5, 312

(56) References Cited

U.S. PATENT DOCUMENTS 5,052,468 * 10/1991 Koenig ..... 164/457
5,207,267 * 5/1993 Iwamoto et al. ..... 164/457
5,299,626 * 4/1994 Iwamoto ..... 164/457
5,365,999 * 11/1994 Stummer et al. ..... 164/457
5,662,159 * 9/1997 Iwamoto et al. ..... 164/457
5,887,641 * 3/1999 Iwamoto et al. ..... 164/155.3
5,957,192 * 9/1999 Kitamura et al. ..... 164/457
5,988,260 * 11/1999 Iwamoto et al. ..... 164/457

FOREIGN PATENT DOCUMENTS 9-239515 * 3/1996 (JP) .
9-323150 * 6/1996 (JP) .

* cited by examiner

*Primary Examiner*—Harold Pyon
*Assistant Examiner*—Len Tran
(74) *Attorney, Agent, or Firm*—Pillsbury Winthrop LLP

(57) ABSTRACT

In a die-casting machine having an injection cylinder device (10) for injecting molten material to a casting die and a boost cylinder device (20) for boosting a hydraulic oil supplied to the injection cylinder device (10), back-pressure of the injection cylinder device (10) and back-pressure of the boost cylinder device (20) are synchronously controlled by a flow-rate control valve (17) capable of continuously adjusting flow-rate of the hydraulic oil discharging channel (16). Accordingly, boosting characteristic can be made in accordance with burr critical boost curve, thereby avoiding burr occurrence in die-casting products in advance. Therefore, high-quality die-casting products without burrs can be manufactured even in a high-speed casting method or using low-accuracy dies.

15 Claims, 9 Drawing Sheets

INJECTION CONTROL METHOD AND DEVICE OF DIE-CASTING MACHINE

BACKGROUND OF THE INVENTION

1. Field of the Invention

The present invention relates to an injection control method and injection control device of a die-casting machine, which can be specifically used for injection control of a die-casting machine for manufacturing high-quality die-casting products without burr occurrence.

2. Description of Related Art

Conventionally, it is known that quality of die-casting molding products is largely affected by an injection speed and injection pressure in filling molten material into mold die. Especially, sufficient pressurization is required before the molten material solidifies and therefore a die-casting machine having double-stage driving cylinder devices for injection and boost has been used.

Generally, in the die-casting machine of this type, an injection plunger advances at a low speed and the molten material is started to be filled into the mold cavity while avoiding the molten material from getting choppy. When an end of the molten material reaches a gate portion of the die and pressure of filling injection cylinder device increases, the injection plunger is advanced at a high speed for avoiding the temperature of the molten material from being lowered to fill the mold cavity with the molten material rapidly.

In succession to the injection process, when the molten material is filled into the mold die to further raise the pressure of the injection cylinder device or when the injection plunger reaches a predetermined position corresponding to completion of filling, high pressure is applied to a boost cylinder device to conduct boosting process for increasing pressurizing force of the injection pressure in the mold die.

Specific arrangement of the conventional double-stage cylinder type die-casting machine will be described below.

In FIG. 6, molten material 92 to be filled in the mold cavity 91 is supplied to injection sleeve 93 of a die-casting machine 90. An injection plunger 94 is driven by a filling injection cylinder device 95 to inject the molten material 92. After completing filling process, hydraulic oil at a backside of the injection cylinder device 95 is pressurized by boost cylinder device 96 with a large diameter to a high pressure to boost the molten material 92 filled in the mold cavity 91 through the injection cylinder device 95.

Injection speed level CV and injection pressure level CP during injection process and boosting process in the die-casting machine are shown in FIG. 7. In the figure, the injection cylinder device 95 advances initially at a low speed VL and fills the molten material rapidly at a high speed VH from time point t1 which is braked by virtue of filling pressure of the molten material 92 in accordance with completion of filling process. The boost cylinder 96 is actuated at time point t2 to pressurize the molten material 92 so that the molten material 92 in the mold cavity 91 reaches pressure PH. The injection cylinder 95 is further advanced and is stopped at time point t3 when solidification of the molten material is completed.

For linking control of the injection cylinder device 95 and the boost cylinder device 96 (switching process from the injection process and the boosting process), sequence-valve method for detecting injection pressure fluctuation to conduct switch and limit-switch method for detecting the advancing position of the injection plunger have been used.

Following hydraulic circuit is used in the above sequence valve method.

In FIG. 8, an injection hydraulic circuit 114 from a check valve 111 and injection speed control valve 112 to an accumulator 113 is connected to the injection cylinder device 95. On the other hand, a boost hydraulic circuit 117 reaching the accumulator 113 through a pilot operation boost control valve 116 to be opened and shut by a sequence valve 115.

The sequence valve 115 opens the boost control valve 116 when the pressure of the injection hydraulic circuit 114 exceeds a predetermined boost initiation pressure. Accordingly, when advancement of the injection cylinder device 95 is started by operating the injection speed control valve 112 for conducting the injection process and filling pressure is increased in accordance with completion of filling molten material into the mold die to reach the predetermined boost initiation pressure, the sequence valve 115 is actuated to open the boost control valve 116 to start advancement of the boost cylinder device 96, thereby conducting boosting process.

As shown in FIG. 9, the injection cylinder device 95 has an injection piston 95A, which is advanced by hydraulic pressure of hydraulic oil supplied to a backside thereof by the injection hydraulic circuit 114. Flow-rate of the hydraulic oil from the injection hydraulic circuit 114 is controlled by the injection speed control valve 112 to switch advancement and suspension of the injection piston 95A and adjust advancing speed thereof.

The boost cylinder device 96 has a boost piston 96A thereinside, which is advanced by hydraulic pressure of the hydraulic oil supplied to a backside thereof from the boost hydraulic circuit 117 to pressurize the injection piston 95A from backside through an intermediate member 95B of the injection cylinder device 95. The flow of the hydraulic oil from the boost hydraulic circuit 117 is controlled by the boost control valve 116, which switches advancement and suspension of the boost piston 96A.

On-off operation of the boost control valve 116 is conducted by the sequence valve 115. An electrovalve or the like for switching in response to filling pressure by an appropriate means is suitably used for the sequence valve 115.

Incidentally, in the above-described double-stage die-casting machine, the flow-rate of the hydraulic oil given to the boost cylinder device stays constant without being variably controlled in the boosting process for boosting the injection cylinder device by the boost cylinder device. This is because on-off operation of the hydraulic oil is conducted by the boost control valve and an on-off two-position switching type constant flow valve is conventionally used for the boost control valve.

Since the hydraulic oil is supplied at a constant flow-rate to the boost cylinder device, boost characteristics of casting pressure becomes the injection pressure level CP shown in FIG. 7, in which increase curve is represented as a quadratic curve being less gradient as approaching to maximum pressure PH. This is because the injection plunger receives much resistance in accordance with solidification of the molten material in the mold die and the boost is blunted. More specifically, the casting pressure P is in proportion to square root of product of elapsed time t and parameter a.

On the other hand, burr critical boost curve is known in boosting process. The burr is generated when an excessive pressure is applied to the mold die in boosting process etc. to leak the molten material from parting surface of the mold die. The burr critical boost curve is given as a curve CX where the casting pressure P is in proportion to a product of square of elapsed time t and parameter a (see FIG. 7).

The burr critical boost curve CX becomes such quadratic curve because the molten material in the mold die is not solidified at the initial stage of boosting process and fluidity of the molten material is high enough to leak the molten material from the parting surface, which prevents high pressure from being applied. On the other hand, when the molten material is solidified in accordance with elapsed time, the leakage to the parting line is hard to be caused, so the burr is not likely to be generated when high pressure is applied.

However, in the conventional die-casting machine where the hydraulic oil is supplied to the boost cylinder device at a constant flow-rate, the boost characteristic of the casting pressure is difficult to be approximated to the burr critical boost curve, so that burrs are frequently generated in conducting high-speed casting or using a mold die having low parting surface accuracy, which makes it impossible to manufacture die-casting products with high-quality.

SUMMARY OF THE INVENTION

An object of the present invention is to provide a injection control method and device of a die-casting machine for manufacturing high-quality die-casting products without burrs even in high-speed casting and mold die of low accuracy.

To achieve the above object, after filling the molten material into the cavity by advancing the injection piston, the pressure is controlled in accordance with a predetermined selective boost curve set along a burr critical boost curve for avoiding burr occurrence in the casting die during boosting process by the boost cylinder device in the present invention. More specifically, the present invention is arranged as follows:

A method according to the present invention is an injection control method of a boost-type die-casting machine including an injection plunger for injecting molten material into a casting die, an injection cylinder device having an injection piston for driving the injection plunger, and a boost cylinder device for boosting hydraulic oil supplied to the injection cylinder device. The method is characterized in including the steps of: providing a flow-rate control valve capable of continuously regulating flow-rate of hydraulic oil discharging channel of the injection cylinder device; and, during boosting process by the boost cylinder device, synchronously controlling back-pressure of the injection cylinder device and back-pressure of the boost cylinder device.

A device according to the present invention is an injection control device of a boost-type die-casting machine having an injection plunger for injecting molten material to a casting die, an injection cylinder device having an injection piston for driving the injection plunger, and a boost cylinder device having a boost cylinder for boosting hydraulic oil supplied to the injection cylinder device. The device is characterized in further having; a flow-rate control valve capable of continuously controlling a flow-rate in a hydraulic discharging channel of the injection cylinder device; and a synchronous controller for synchronously controlling a back-pressure of the injection cylinder device and a back-pressure of the boost cylinder device during boosting process by the boost cylinder device.

According to the above arrangement, since the flow-rate in the hydraulic oil discharging channel is continuously controlled by the flow-rate control valve to set the flow-rate variable, boost characteristic can be adjusted to correspond to the burr critical boost curve, thereby preventing generating burr in advance. Accordingly, high-quality die-casting products without burr can be manufactured even in high-speed casting or using low-accuracy mold die. Further, since both of the back-pressures of the injection cylinder and the boost cylinder, the size of the device can be reduced.

Incidentally, either one of open-control and real-time feedback control can be preferably used for the control method.

In the method of the present invention, the flow-rate control valve is preferably controlled so that a relationship between casting pressure and boost time in the casting die is changed in accordance with a selective curve along a predetermined critical boost curve for avoiding burr occurrence to the casting die during the synchronous controlling process.

In the device of the present invention, the synchronous controller preferably controls the flow-rate control valve so that a relationship between a casting pressure and boost time of the casting die changes in accordance with a selective curve along a predetermined critical boost curve for avoiding burr occurrence to the casting die during the synchronous controlling process.

In the above arrangement, since the boosting process is conducted by a flow-rate control valve composed of a high-responsive electrohydraulic servovalve using a controller along a predetermined critical curve not causing the burr, the burr can be prevented from generating, thus manufacturing high-quality die-casting products without burr even in high-speed casting or using low accuracy mold die. Further, since the high-responsive electrohydraulic servovalve is used, responsivity and accuracy can be improved.

In the method of the present invention, the flow-rate control valve is preferably controlled by comparing a detected pressure value detected by the injection cylinder device and the boost cylinder device and a command pressure value for every elapsed time given in accordance with a predetermined program to eliminate difference between the pressure values.

In the device of the present invention, the synchronous controller preferably compares a detected pressure value detected by the injection cylinder device and the boost cylinder device and a command pressure value for every elapsed time given in accordance with a predetermined program and controls the flow-rate control valve to eliminate difference between the pressure values.

According to the above arrangement, since the control is conducted along the predetermined critical curve not causing the burr, the burr generation can be prevented in advance, thereby manufacturing high-quality die-casting products without burr even in high-speed casting process or using low-accuracy mold die.

In the method according to the present invention, the flow-rate control valve is preferably controlled by comparing difference between the detected pressure value and the command pressure value and open-degree of the flow-rate control valve so that the open-degree corresponds to the difference.

In the device according to the present invention, the synchronous controller preferably compares difference between the detected pressure value and the command pressure value and open-degree of the flow-rate control valve and controls the flow-rate control valve so that the open-degree corresponds to the difference.

According to the above arrangement, responsivity of open-degree control and accuracy of the flow-rate control valve can be improved.

In the device according to the present invention, the flow-rate control valve may preferably be a high-responsive electrohydraulic servovalve.

According to the above arrangement, the responsivity and accuracy of the flow-rate control valve can be improved.

In the device of the present invention, the hydraulic discharging channel of the injection cylinder device and a hydraulic discharging channel from the boost cylinder device are preferably connected.

According to the above arrangement, since back-pressure side of the injection cylinder device and the boost cylinder device are interconnected for synchronization and both of the back-pressures of the injection cylinder and the boost cylinder can be controlled, the size of the device can be reduced.

In the device according to the present invention, the flow control valve preferably has a main spool to be opened and shut by a pilot servovalve.

According to the above arrangement, the open-degree can be more accurately and easily controlled by the main spool.

In the above, a position sensor for detecting open-degree of the main spool may preferably be provided.

According to the above arrangement, the open-degree of the main spool can be accurately and easily conducted.

A command signal outputted by the position sensor and a difference between a command pressure value outputted by a boost controller and a detected pressure value detected by the injection cylinder device and the boost cylinder device are preferably fed back to an input of the pilot servovalve.

According to the above arrangement, responsivity and accuracy of the open-degree control of the main spool can be improved.

In the device according to the present invention, the synchronous controller may further have a pressure detector for detecting a casting pressure of the injection cylinder device, a pressure processor for processing an output from the pressure detecting means, a boost controller for outputting a command pressure value for every elapsed time according to a predetermined program, and a comparator for calculating a difference between a pressure outputted by the pressure processing means and a command pressure value outputted by the boost controller.

And, the synchronous controller may further have a servo amplifier for controlling the flow-rate control valve so that a relationship between a casting pressure and boost time of the casting die changes in accordance with a selective curve along a predetermined critical boost curve for avoiding burr occurrence to the casting die during the boosting process by the boost cylinder device based on a difference outputted by the comparator.

According to the above arrangement, since the boosting process is conducted along a predetermined critical curve without generating burr, the burr generation can be prevented in advance, thereby high-quality die-casting products without burr can be produced even in high-speed casting process or by using a mold die with low-accuracy.

In the device of the present invention, a boost control valve for controlling boosting time may preferably provided on a hydraulic oil supply side of the boost cylinder.

In the above arrangement, the boost control valve may have a spool movable by operating a switching valve and an adjusting stopper for adjusting a moving amount of the spool, a distal end portion of the hydraulic oil supply side of the spool being tapered for narrowing the flow-rate of the hydraulic oil to regulate pressure and flow-rate of pressurizing portion of the boost piston.

According to the above arrangement, since the spool of the boost control valve is configured in a shape capable of narrowing the flow-rate of the hydraulic oil, even when a trouble disabling the function of the flow-rate control valve is occurred, the open-degree of the spool can be adjusted to be small using the adjusting stopper to set a spool open-degree position capable of obtaining predetermined boost curve. Accordingly, normal boosting process can be temporarily secured.

DETAILED DESCRIPTION OF PREFERRED EMBODIMENT(S)

An embodiment of the present invention will be described below with reference to attached drawings.

Since the present embodiment is implemented by modifying a control method of existing die-casting machine and primary components of the existing die-casting machine (e.g. above-described arrangement of the die-casting machine shown in FIGS. 6 to 9) such as mold die and injection plunger can be selectively used, description thereof is omitted. And description of injection cylinder device, boost cylinder device and hydraulic circuit for supplying hydraulic oil thereto will be mentioned below.

Figure 1:
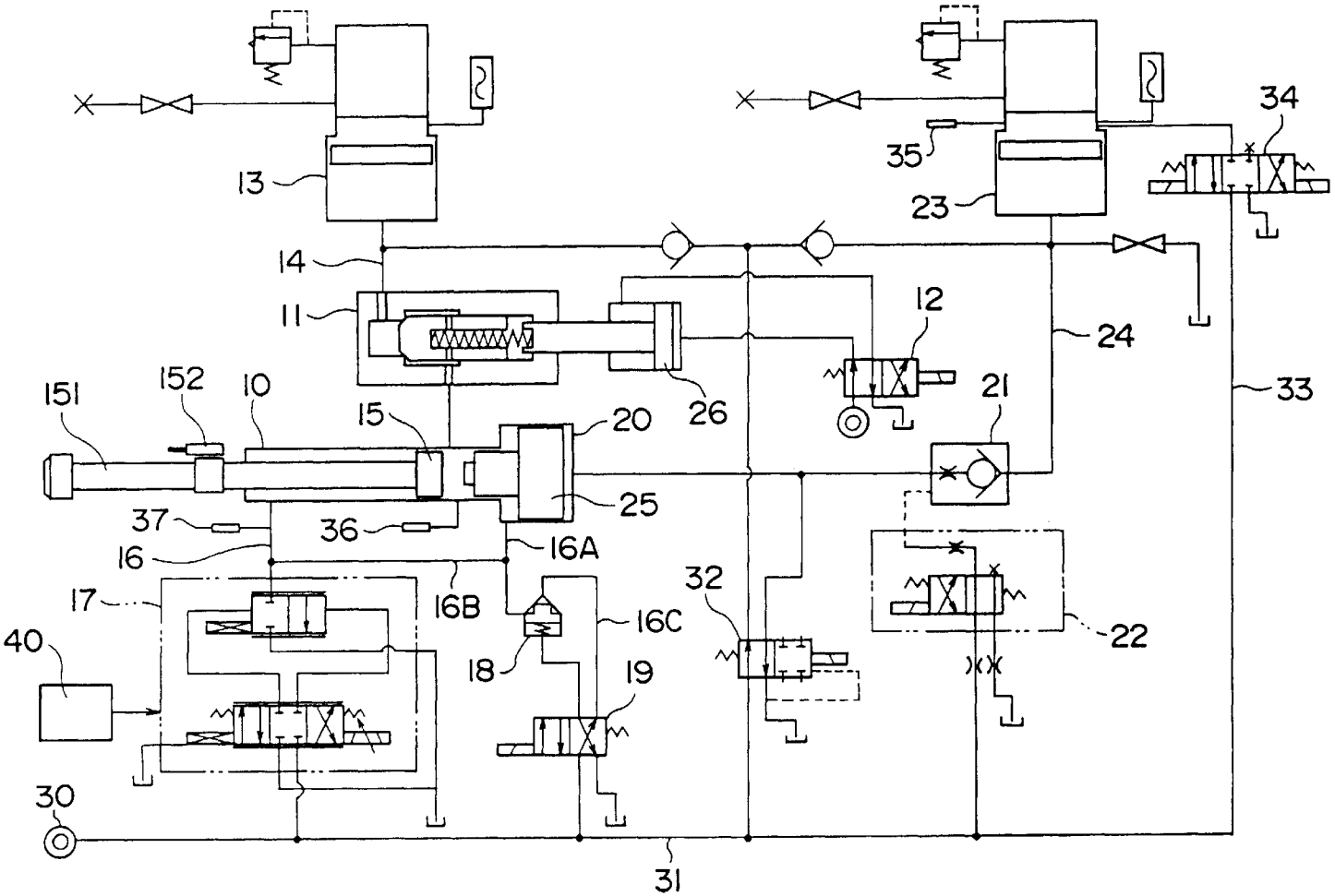
FIG. 1 is a schematic diagram showing an embodiment of the present invention.

In FIG. 1, an injection hydraulic circuit 14 extending through a pilot check valve 11 to an injection accumulator 13 is connected to an injection cylinder device 10. The check valve 11 is controllably opened and shut by a open-shut electroswitching valve 12, which is manipulated to open the check valve 11 to feed the hydraulic oil from the injection accumulator 13 to the injection cylinder device 10 to advance the injection piston 15.

When the hydraulic flow from the injection accumulator 13 to the injection cylinder device 10 is stopped to eliminate differential pressure between inlet and outlet, the check valve 11 prevents backflow of the hydraulic oil during boosting process by moving a valve body by a spring provided thereinside.

A hydraulic discharging channel 16 for discharging the hydraulic oil of the rod of the injection piston 15 is connected to the injection cylinder device 10 and an injection speed controlling flow-rate control valve 17 is connected to the hydraulic discharging channel 16.

The injection speed controlling flow-rate control valve 17 is composed of high-speed responsive large-flow servovalve, of which spool open-degree is controlled to narrow the hydraulic discharging channel 16 in advancing the injection cylinder device 10 to apply back-pressure to the injection piston 15 to adjust advancing speed.

A boost hydraulic circuit 24 extending through a boost control valve 21 controllably opened and shut by a switching valve 22 to a boost accumulator 23 is connected to a boost cylinder device 20. The boost control valve 21 is opened by operating the switching valve 22, so that the hydraulic oil from the boost accumulator 23 is supplied to the boost cylinder device 20 to advance the boost piston 25.

Figure 2:
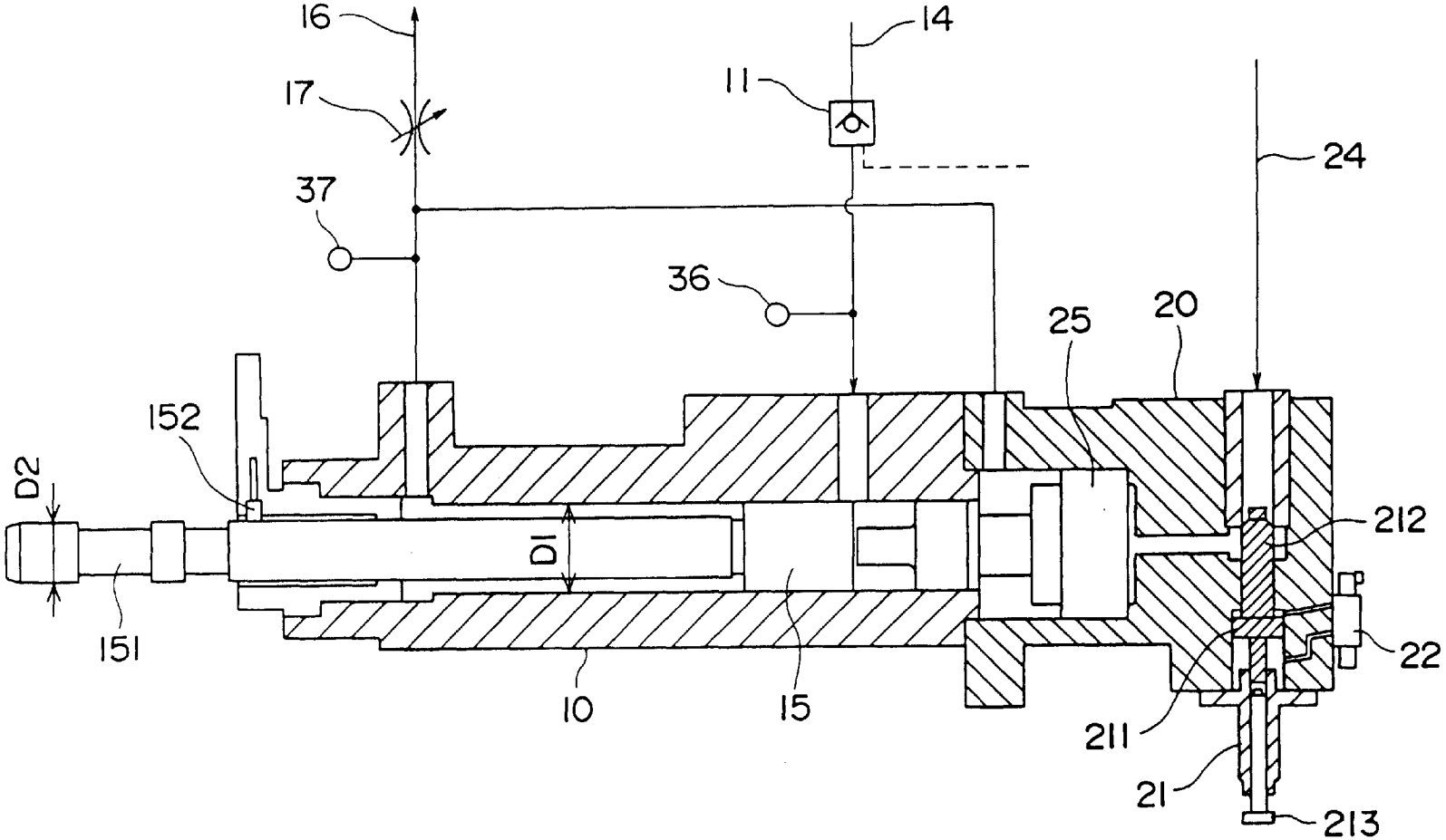
FIG. 2 is a cross section showing cylinder device of the aforesaid embodiment.
Figure 3:
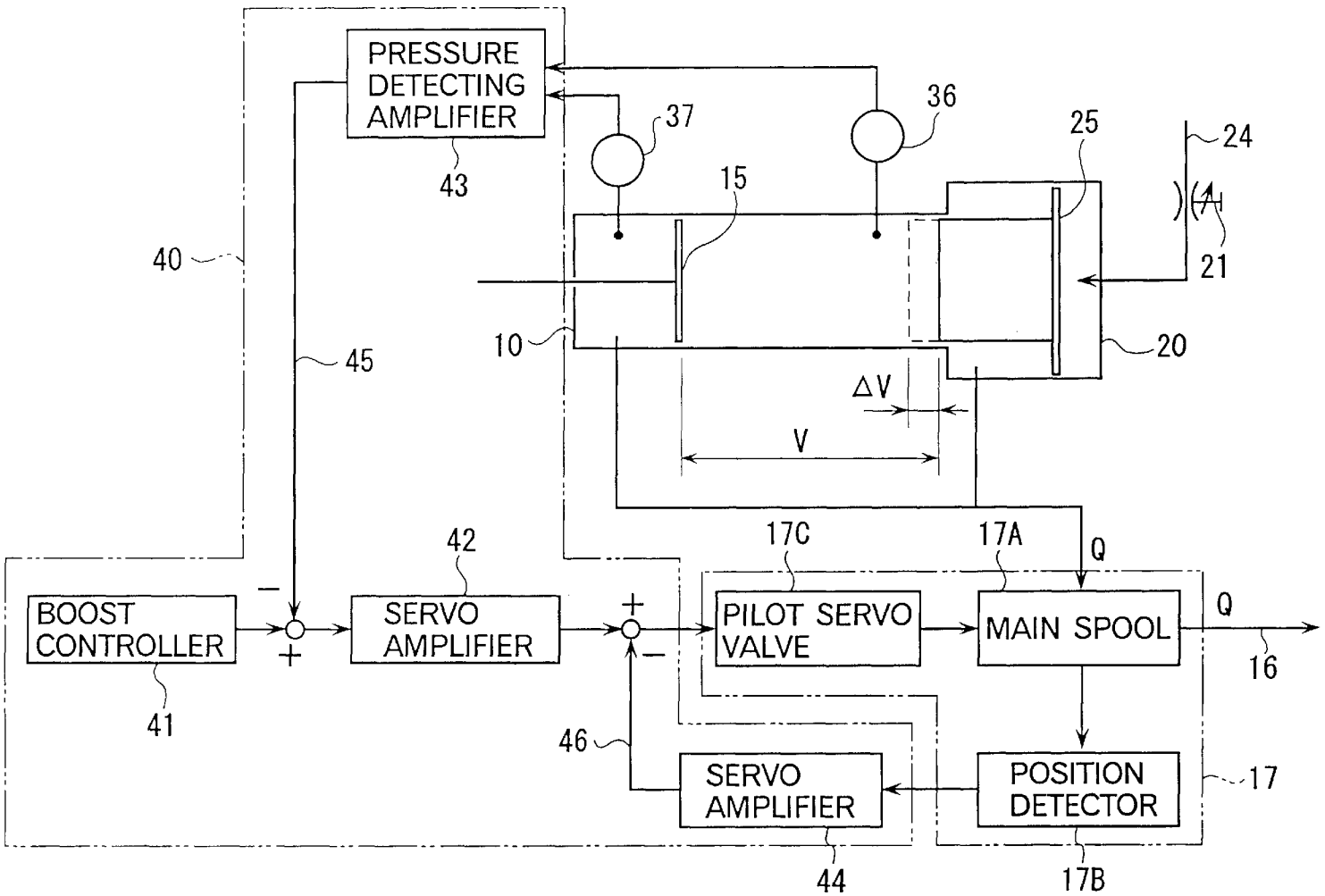
FIG. 3 is a block diagram showing a control system of the aforesaid embodiment.

As shown in FIG. 2, the boost control valve 21 has a spool 211 of which maximum moving amount is externally controlled by a screw member 213 as an adjusting stopper. Accordingly, supplied hydraulic oil flow-rate can be changed according to a configuration and moving amount of the spool.

The boost cylinder device 20 has a boost cylinder discharging channel 16A, which is connected to the hydraulic discharging channel 17 of injection piston through a branch channel 16B. The injection speed controlling flow-rate control valve 17 is connected to the hydraulic oil discharging channel 16. In other words, the injection cylinder device 10 and the boost cylinder device 20 jointly owns the flow-rate control valve 17. The injection cylinder device 10 and the boost cylinder device 20 are synchronously controlled by the flow-rate control valve 17.

As mentioned above, the flow-rate control valve 17 is made of high-speed responsive large-flow servovalve, of which spool open-degree is adjusted to narrow the hydraulic oil discharging channel 16 to apply back-pressure to the injection piston 15 and the boost piston 25 to control advancing speed. The back-pressure is detected by a pressure sensor 37.

The flow-rate control valve 17C has a pilot servovalve 17C for opening and shutting the main spool, and output of a position sensor for detecting the open-degree of the main spool is double-stage servo mechanism for feedback to an input of the pilot servovalve 17C.

The flow-rate control valve 17 controls the advancing speed by adjusting the main spool open-degree when the injection cylinder device 10 is advanced. When the injection cylinder is advanced, the boost piston 25 is at a retraction limit. In other words, the boost piston 25 is at a position remote from the position of the injection piston 15 and the hydraulic oil is filled between the pistons 15 and 25. The boost by the boost cylinder 20 is started with both of the pistons 15 and 25 being separated.

As shown in FIG. 1, hydraulic oil feeding channel 31 from a hydraulic source 30 is connected to the injection accumulator 13 and the boost accumulator 23, to which high-pressure hydraulic oil is supplied. An electromagnetic accumulator fill switching valve 32 is disposed at a halfway of the hydraulic feeding channel 31 for conducting on-off operation of hydraulic oil supply to the respective accumulators 13 and 23. Generally speaking, since the injection process is conducted based on oil amount in the accumulator, the switching valve 32 is used in a shut condition. However, when accumulator pressure is decreased, the switching valve 32 is opened to fill respective accumulators with pressure oil.

A branch channel 33 from the hydraulic oil feeding channel 31 is connected to a backside of the boost accumulator 23, and an electromagnetic casting pressure control valve 34 is disposed at a halfway thereof The back-pressure of the boost accumulator 23 is increased by feeding the hydraulic oil from the hydraulic source 30 by the casting pressure control valve 34, so that the maximum hydraulic pressure of the boost hydraulic circuit 24 is increased to increase the maximum casting pressure applied to the boost cylinder device 20.

On the contrary, when the hydraulic oil is discharged by the casting pressure control valve 34 to decrease the back-pressure of the boost accumulator 23, the maximum hydraulic pressure of the boost hydraulic circuit 24 is reduced to lessen the maximum casting pressure applied to the boost cylinder device 20.

A sensor 35 for detecting the pressure at the backside is disposed to the boost accumulator 23, so that back-pressure value of the boost accumulator 23 can be checked in the above-described adjusting process of the casting pressure.

As shown in FIG. 1, a pressure sensor 36 for detecting boost on a head side and a pressure sensor 37 for detecting back-pressure on a rod side are disposed to detect the casting pressure of the injection cylinder device 10, respectively directly checking injection pressure value in adjusting the above-described casting pressure. For example, the injection pressure value can be more correctly detected by a pressure difference between head side B and rod side A than an actual pressure value. Incidentally, in accordance with ratio between a diameter D1 of the injection piston 15 and a plunger chip D2 of an injection plunger 151, the injection pressure PR is given as a value of product of detected pressure PS and square of (D1/D2).

An encoder 152 for detecting advance position of the injection plunger 151 is disposed to the injection cylinder device 10, so that stroke position in injection process can be directly detected.

A controller 40 is provided for receiving signals from respective sensors 36, 37 etc. and for controlling operation of respective valves.

The controller 40 is constructed mainly of existing computer systems, programmable controllers etc., which operates respective valves according to predetermined operation program in accordance with predetermined steps to implement injection and boosting.

The controller 40 controls respective portion in accordance with predetermined programs to perform injection process and boosting process, which includes a controlling circuit for controlling the speed controlling flow-rate control valve 17 and for actuating the boost cylinder device 20 to conduct boosting process. The controller 40 has a boost controller 41 as a boost controlling means, a servo amplifier 42, a pressure detecting amplifier 43 and a position feedback servo amplifier 44.

The boost controller 41 works according to a predetermined program and outputs command pressure value based on the elapsed time in boosting process in accordance with predetermined boost control setting curve. The servo amplifier 42 manipulates the pilot servovalve 17C of the speed controlling flow-rate control valve 17 according to output of the boost controller 41 to regulate the open-degree of the main spool 17A.

The pressure detecting amplifier 43 deals with the output from the respective pressure sensors 36 and 37 to output a boost feedback signal 45 to the input side of the servo amplifier 42. At this time, the pressure detecting amplifier 43 is capable of selectively outputting either one of the outputs of the respective pressure sensors 36 and 37 or combinedly operating respective outputs to output.

The position feedback servo amplifier 44 deals with open-degree position of the main spool detected by the position sensor of the flow-rate control valve 17 to output a minor feedback signal 46 to the output side of the servo amplifier 42.

When the boosting process is implemented by the controller 40, command pressure value according to the elapsed time is outputted from the boost controller 41 and the servo amplifier 42 regulates the open-degree of the main spool 17A in accordance with the command pressure value by the pilot servovalve 17C of the flow-rate control valve 17. Then, flow of the hydraulic oil corresponding to the open-degree of the main spool of the flow-rate control valve 17 disposed in the hydraulic discharging circuit 16 to conduct boosting process thereby increasing the pressure inside the injection cylinder device 10.

The pressure is detected by the respective pressure sensors 36 and 37 and is looped back to the input side of the servo amplifier 42 as a pressure feedback signal 45. Boost control in response to the command pressure value from the boost controller 41 in accordance with elapsed time is conducted by the pressure feedback path, which improves responsivity and precision of boosting process in accordance with a boost control setting curve.

Incidentally, the respective pressure sensors 36, 37 and the pressure detecting amplifier 43 are not necessarily provided, in other words, the pressure feedback signal 45 is not inputted to the servo amplifier 42 but boost control in accordance only with the command pressure value of the boost controller 41 may be conducted.

The open-degree of the main spool 17A is looped back to the Output of the servo amplifier 42 (input of the pilot servovalve) as the minor feedback signal 46 through the position sensor 17B and the position feedback servo amplifier 44. The minor feedback path improves responsivity and precision of the open-degree control of the main spool.

Further, as shown in FIG. 1, a retraction circuit 16C for retracting the injection piston 15 of the injection cylinder device 10 and the boost piston 26 of the boost cylinder device 20 are connected to the discharging circuit 16A of the boost cylinder 20. A logic valve 18 and an open-shut switching valve 19 are provided to the retraction circuit 16C. When the hydraulic oil is fed from the hydraulic oil feeding circuit 31 in the condition shown in the drawing, the hydraulic oil is fed to a back-pressure side of the injection cylinder device 10 and the boost cylinder device 20, thereby retracting respective pistons 15 and 25.

In the above arrangement, the controller 40 controls respective portions in accordance with a predetermined program to perform prearranged injection process and boosting process.

Specifically, the plunger 151, the piston 15 and the piston 20 of the boost cylinder 20 start at a retraction limit position.

Initially, the molten material is fed to the injection sleeve to be thus capable of being injected to the mold die, the check valve 11 is opened to feed the hydraulic oil from the injection accumulator 13 to the injection cylinder device 10 to advance the injection plunger 151.

At this time, the injection speed controlling flow-rate control valve 17 is narrowed to set the injection speed at low. Subsequently, when the injection plunger 151 is advanced to a position where the molten material reaches the die gate, the injection speed controlling flow-rate control valve 17 is opened to fill the molten material at a stroke into the mold die by switching the injection speed high. When the injection plunger 151 comes to a predetermined position (detected by a position sensor 152) or the pressure sensors 36 and 37 show a predetermined value, the switching valve 22 is operated to open the boost control valve 21 while conducting the control by the injection speed controlling valve 17, so that the hydraulic oil from the boost accumulator 23 is supplied to the backside of the boost piston 25 of the boost cylinder device 20 to pressurize the hydraulic oil at back-pressure side of the boost piston 25 of the boost cylinder device 20. The boost piston 25 pressurize the hydraulic oil at the back-pressure side of the injection piston 15 to pressurize the injection plunger 151 from the backside of the injection piston 15 through the pressurized hydraulic oil.

The speed controlling flow-rate control valve 17 is controlled so that the pressure at the intermediary stage of boosting and the time before reaching the maximum pressure is controlled to draw a boost pressure curve approximated to the burr critical boost curve defined in advance by measurement etc. by narrowing the main spool open-degree of the control valve 17 and changing the open-degree at the intermediary of the process while checking the present boost feedback signal 45 in accordance with the boost control setting curve.

In the boost controller, the boost control setting curve is defined as follows.

Figure 4:
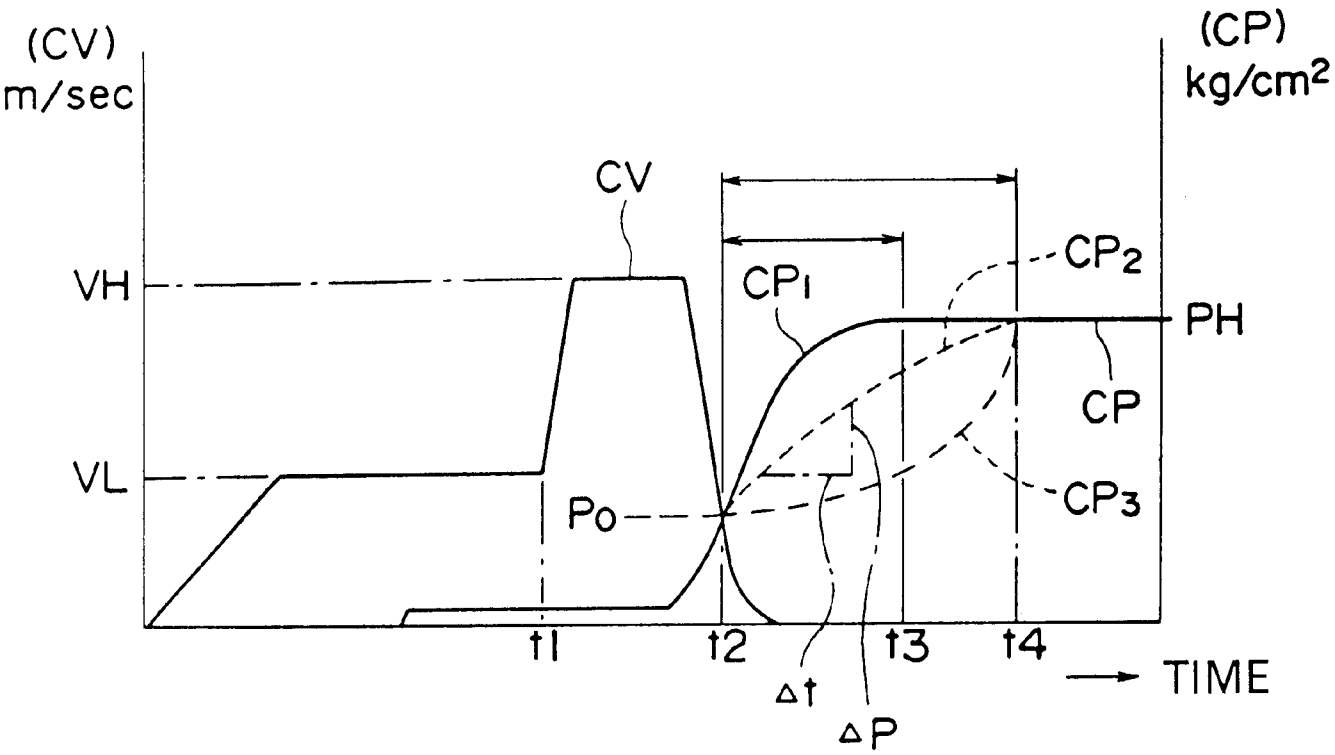
FIG. 4 is a graph showing injection process and boosting process of the aforesaid embodiment.

In FIG. 4, the boost curve CP1 is a boost curve of an existing die-casting machine, which gradually comes less slanted. On the other hand, when the main spool open-degree of the boost flow-rate control valve 17 is narrowed, inclination of the pressure increase becomes less slanted as the boost curve CP2 and the time before reaching the maximum pressure PH become longer. When the spool open-degree of the flow-rate control valve 17 is widened, the pressure increase speeds up as time elapses to reach the maximum pressure PH at time t4.

The boost time (t4–t2) shown in FIG. 4 is a short time period of approximate 50 to 100 msec. Though the boost curve CP2 by the conventional on-off two position switching is influenced by impact pressure and surge pressure when the valve is switched for boosting process, since the inclination is less slanted than the conventional boosting, the influence is not applied.

In order to obtain desired lenient inclination characteristics, as shown in FIG. 2 and as described above, the configuration of the distal opening of the spool 211 of the boost control valve 21 (flowing side of the hydraulic oil) is tapered, in other words, a stepped configuration having smaller diameter of distal end than a body so that the flow-rate can be regulated by moving the spool 211 and the spool maximum moving amount at the maximum spool open-degree can be adjusted by the screw member 213 as a stopper member. Accordingly, as shown in FIG. 4, the boost curve CP3 can be modified to have a desired kick-off characteristics, thereby obtaining a curve similar to the above-described burr critical curve CX in FIG. 7.

The flow-rate narrowing configuration of the opening of the spool 211 of the boost control valve 21 is defined considering following case too.

If the boost control valve 21 has no above-described flow-rate narrowing function, when the flow-rate control valve 17 does not work for some reason, die-casting boost function is disabled because pressure control is impossible.

However, when the spool 211 of the boost control valve 21 is configured in a shape capable of narrowing the flow-rate, when the flow of molten material is fed from the boost accumulator 23 to the boost cylinder device 20, the flow-rate passing the spool 211 can be reduced, thereby regulating the pressure and flow-rate to the pressurized portion of the boost piston 25.

According to the opening configuration of the spool 211, the boost characteristic in open condition can be approximated to the burr critical boost curve as possible. When the boost control by regulating the flow control valve 17, the spool is further opened to secure wide open-degree position by the screw member 213.

If a trouble disabling the function of the flow-rate control valve 17 occurs, the screw member 213 is used to adjustably lessen the open-degree of the spool 211 so that a spool open-degree position capable of obtaining desired boost curve is set.

Accordingly, though only a temporary disposition, normal boosting process can be secured.

Thus established boost control setting curve is summarized into data as pressure increment ΔP for each elapsed time Δt of boosting process, which is set in the boost controller 41 to be outputted at the start of operation as a pressure value to be taken at present in response to elapsed time from initiation of the boosting process. In summarizing into the data, ΔP is defined as $$\Delta P/\Delta T=Q/V*\beta,$$

where V is volume of the hydraulic oil to be boosted (volume etc. at the advancement limit position); β is a compressibility of the hydraulic oil; and Q is a flow-rate of the hydraulic oil supplied to the boost cylinder device 20 in boosting process.

ΣΔP of the total sum of ΔP corresponds to difference between boost initiation pressure (fill completion pressure) P0 and boost completion pressure PH.

The data is defined because of following reasons.

The hydraulic oil supplied to the injection cylinder device 10 and the boost cylinder device 20 has a slight compressibility. Therefore, even when the hydraulic oil supply is the same for the respective cylinder device 10 and 20, the advancing position of the injection piston 15 is shifted according to pressure.

For example, assuming that the volume of the hydraulic oil at the head side at the advancement limit position of the injection cylinder device 10 is V and the compressibility of the hydraulic oil is β, there occurs shift of;

$$\Delta V=V(1-\beta).$$

When the casting die is exchanged, since the advancement limit is changed to change the volume of the hydraulic oil in the injection cylinder device 10 at the advancement limit position, the shift is also changed. Accordingly, when the boost control is conducted according only to the position in the injection cylinder device 10 or the supplied hydraulic oil amount (e.g. control only by commanding open-degree of the main spool), exchange of the casting die can not be coped with, thereby requiring changing control command for each casting die.

In contrast thereto, when compression command is defined by relational expression considering the compressibility and the volume, the compression shift of the hydraulic oil can be dealt with only by inputting the volume at the advancement limit and the like in exchanging the casting die, thereby facilitating to deal with the exchange of casting die and securing high-precision control.

Incidentally, actual injection pressure can be checked by the pressure sensors 36 and 37 in the previous boosting process, and the pressure target value is corrected by the learning function of the controller 40 by taking deviation against desired injection pressure. Such control target data processing and correction by the learning function can be implemented by existing software techniques.

According to the present embodiment, following effects can be obtained.

1) Since the hydraulic oil supply flow-rate to the boost cylinder device 20 can be regulated not by on-off operation in boosting process continuously by the controller 40 using the flow control valve 17 of the hydraulic oil discharging channel 16, the flow-rate can be set variable. Accordingly, the boosting process can be controlled in accordance with burr critical boost curve CX, thereby preventing generation of burrs, which enables producing high-quality die-casting products.

2) Since the feedback control by pressure is possible based on the pressure target value in accordance with the boost control setting curve set on the boost controller 41 while checking the actual boost pressure by the pressure sensors 36, 37 and the pressure detecting amplifier 43 for boost control, boosting process in line with the predetermined boost control setting curve can be securely performed even when the mold die is exchanged.

3) High-speed control is possible since both of the control command and the control object are based on pressure so that operation process for feedback control etc. can be simplified.

4) Since the flow-rate control valve 17 has therein a pilot servovalve 17C for controlling the open-degree of the main spool 17A and two-stage servovalve mechanism in which the output of the position sensor 17B is fed back to the input of the pilot servovalve 17C (output of the servo amplifier 42) is used, stability as the servo mechanism can be enhanced, thereby effectively improving response speed and precision in boost control by the variable flow-rate.

5) Since the pressure sensors 36 and 37 respectively provided to the head side B and rod side A of the injection cylinder device 10 and the pressure detecting amplifier 43 for selectively operating either one of respective output or both of them are provided, the actual pressure value in the injection cylinder can be more precisely detected, which is effective for implementing boost control by the variable flow-rate.

6) Since the advancement of the injection cylinder device 10 can be speed-controllably controlled by back-pressure during injection process and the flow-rate control valve can be controlled so that the pressure detected by the pressure sensor follows a predetermined curve in proceeding to the boosting process by the injection speed controlling flow-rate control valve 17, the single flow-rate control valve 17 can be used for both of the injection and boost, thereby reducing the size of the device.

7) Since injection control according to open control and real-time feedback control by the flow-rate control valve 17 using one high-responsive electrohydraulic servovalve can be conducted for controlling the speed and boost of the two cylinder devices 10 and 20, high-quality die-casting products can be manufactured.

8) Since the controller 40 can easily, securely and precisely control the hydraulic oil flow-rate for boosting process for each elapsed time, effective boost control by variable flow-rate is possible.

9) Since the injection accumulator 13 and the boost accumulator 23 are independently provided, the pressure for the injection process and the boosting process can be independently conducted. Further, since the back-pressure of the boost accumulator 23 is controlled by the casting pressure control valve 34, the maximum pressure by the boosting process can be easily and securely controlled at will.

10) Since the spool 211 of the boost control valve 21 is configured in the tapered shape capable of narrowing the flow-rate, when the molten material is fed from the boost accumulator 23 to the boost cylinder device 220, the flow-rate passing the spool 211 can be regulated. Accordingly, even when a trouble disabling the function of the flow-rate control valve 17 is occurred, the open-degree of the spool 211 can be adjusted small to set to an open-degree position capable of obtaining predetermined boost curve, so that the boosting process by the boost control valve 21 is possible, thereby securing normal boosting process, however temporary it may be.

Incidentally, the scope of the present invention is not limited to the aforesaid embodiment, but includes following modification.

Though two accumulators of injection accumulator 13 and the boost accumulator 23 are provided in the above-described embodiment, a single accumulator may be provided to be used for both purposes.

The accumulator fill switching valve 32, the respective pressure sensors 35 and 36, the encoder 152 etc. can be selectively substituted by the other arrangement, or may be omitted as necessary.

The configuration and size, material and the like of the boost control valve 21, the injection speed controlling flow control valve 17 may be appropriately selected for implementation.

Figure 5:
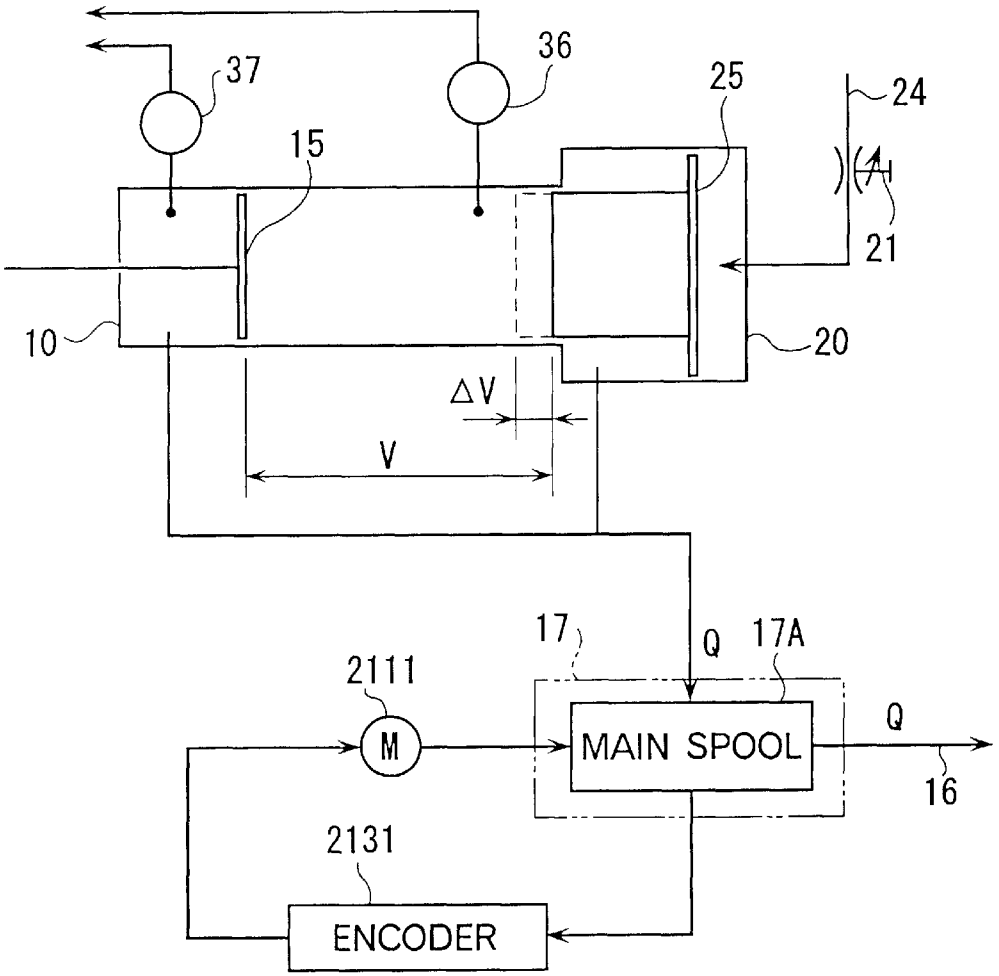
FIG. 5 is a block diagram showing a modification of the aforesaid embodiment.
Figure 6:
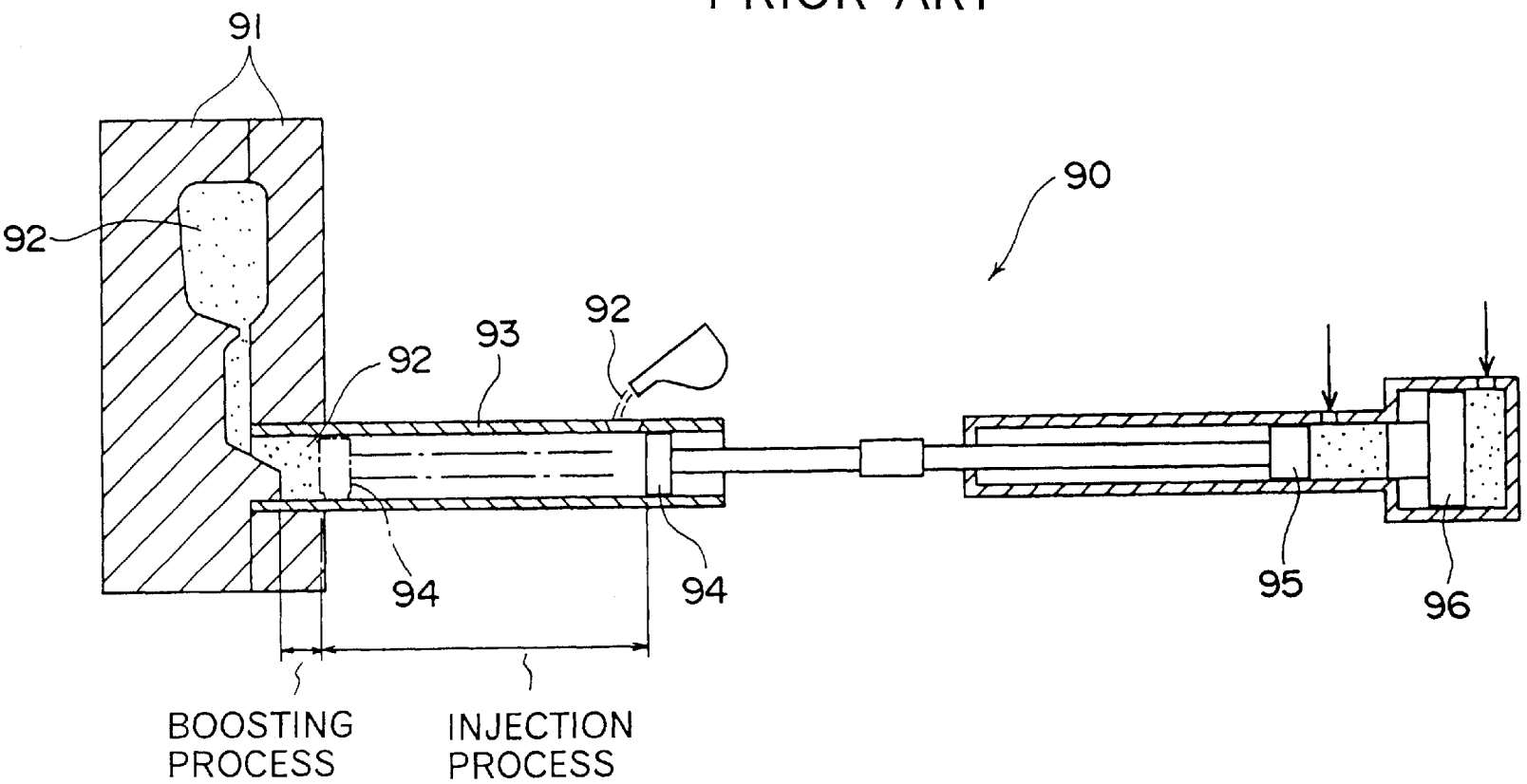
FIG. 6 PRIOR ART
FIG. 6 is a cross section showing basic arrangement of conventional die-casting machine.
Figure 7:
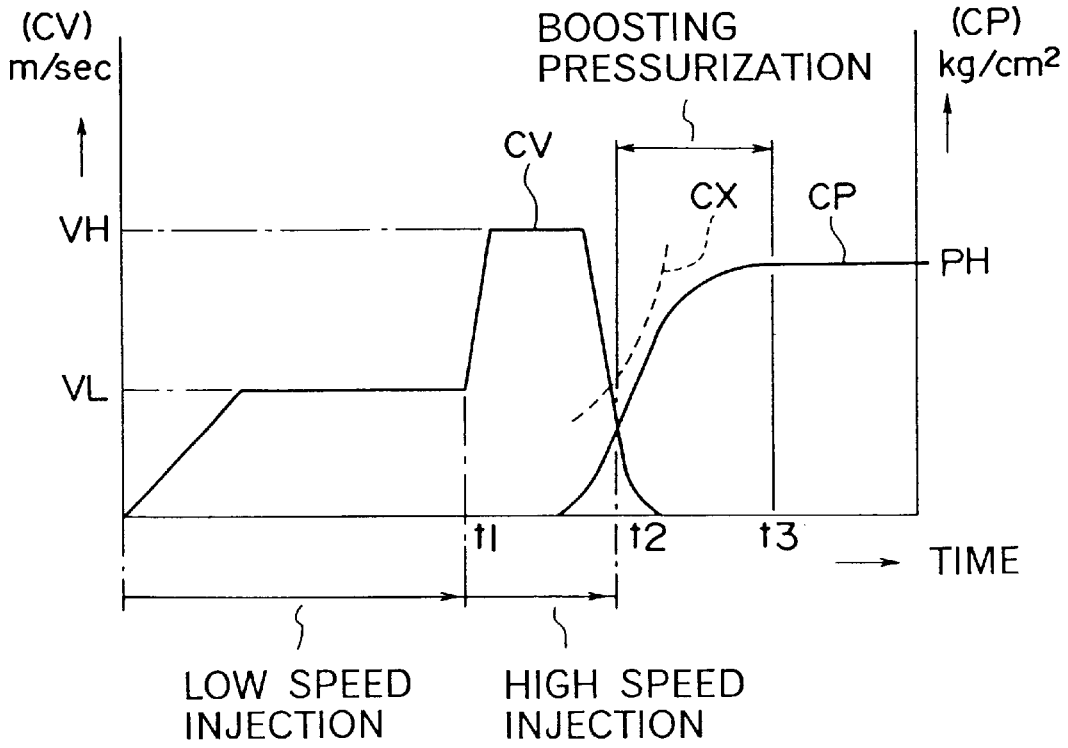
FIG. 7 PRIOR ART
FIG. 7 is a graph showing injection process and boosting process of the conventional die-casting machine.
Figure 8:
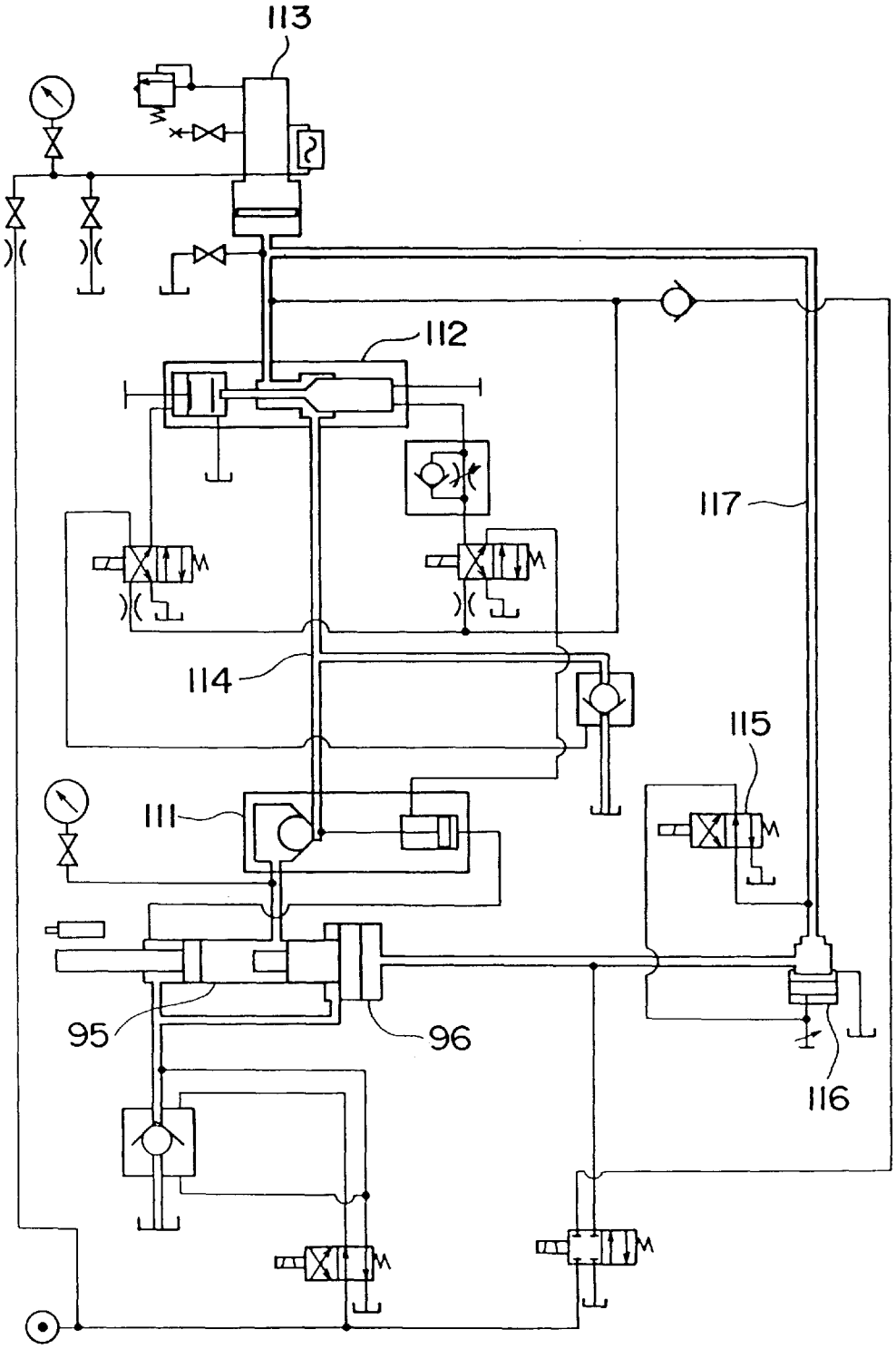
FIG. 8 PRIOR ART
FIG. 8 is a schematic diagram showing a hydraulic circuit of the conventional die-casting machine.
Figure 9:
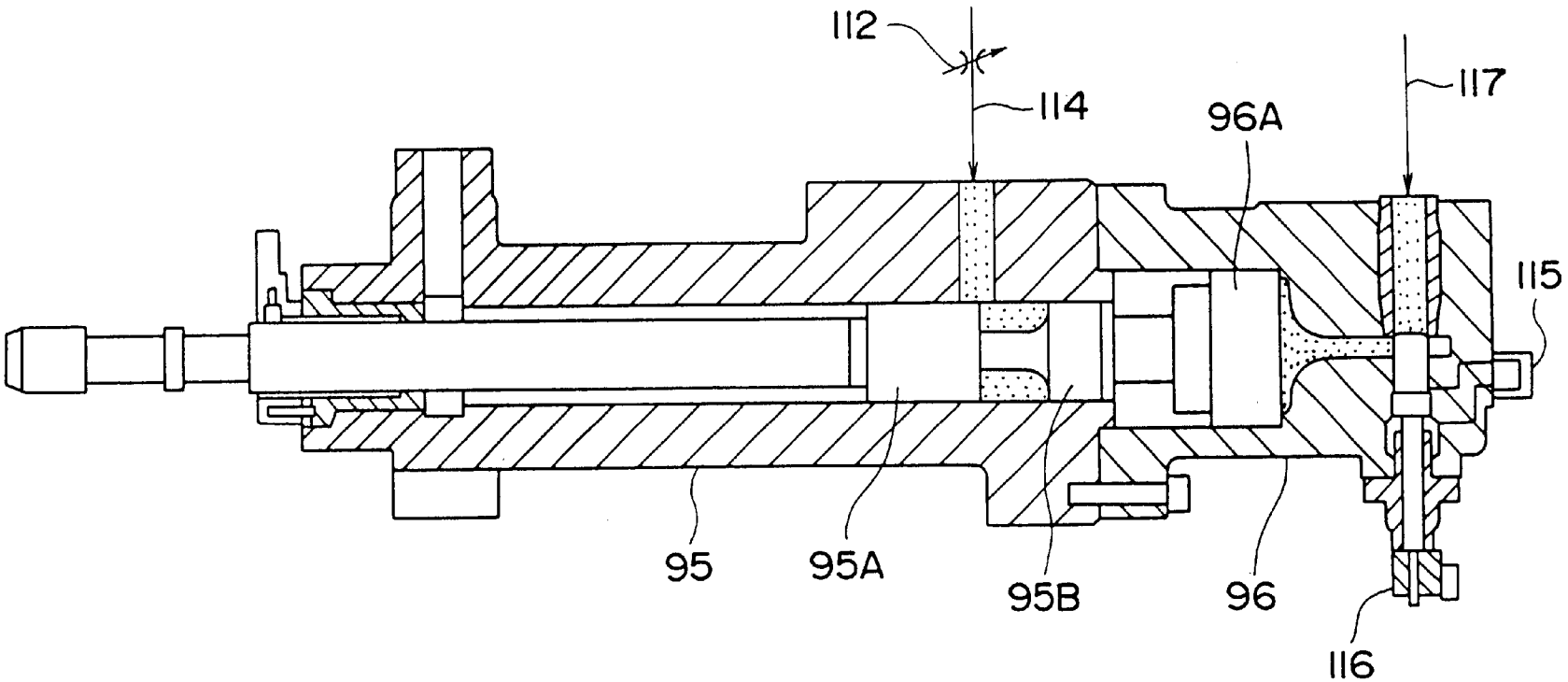
FIG. 9 PRIOR ART
FIG. 9 is a cross section showing a conventional cylinder device.

Further, the flow-rate control valve 17 may be arranged to be servo-driven in accordance with given command open-degree. For instance, as shown in FIG. 5, alternating current or direct current servo motor 2111 may be used as a driving source for adjusting the open-degree of the main spool and a rotary encoder 2131 may be used as a position sensor, thereby forming local position feedback.

What is claimed is:

1. An injection control method of a boost-type die-casting machine including an injection plunger for injecting molten material into a casting die, an injection cylinder device having an injection piston for driving the injection plunger, and a boost cylinder device for boosting hydraulic oil supplied to the injection cylinder device, comprising the steps of:

Providing a flow-rate control valve to continuously regulating flow-rate of hydraulic oil discharging channel of the injection cylinder device; And During boosting process by the boost cylinder device, synchronously controlling back-pressure of the injection cylinder device and back-pressure of the boost cylinder device;

Wherein the flow-rate control valve is controlled so that a relationship between casting pressure and boost time in the casting die changes in accordance with a selective curve along a predetermined critical boost curve for avoiding burr occurrence to the casting die during the synchronous controlling process;

Wherein the flow-rate control valve is controlled by comparing a detected pressure value detected by the injection cylinder device and the boost cylinder device with a command pressure value for every elapsed time given in accordance with a predetermined program to eliminate difference between the pressure values.

2. The injection control method of a die-casting machine according to claim 1, wherein the flow-rate control valve is controlled by comparing difference between the detected pressure value and the command pressure value and open-degree of the flow-rate control valve so that the open-degree corresponds to the difference.

3. An injection control device of a boost-type die-casting machine comprising an injection plunger for injecting molten material to a casting die, an injection cylinder device having an injection piston for driving the injection plunger, and a boost cylinder device having a boost cylinder for boosting hydraulic oil supplied to the injection cylinder device, characterized in further having; a flow-rate control valve to continuously controlling a flow-rate in a hydraulic discharging channel of the injection cylinder device; and a synchronous controller for synchronously controlling a back pressure of the injection cylinder device and a back-pressure of the boost cylinder device during boosting process by the boost cylinder device, wherein the synchronous controller comprising a detecting means for detecting pressure value in the injection cylinder, a detecting means for detecting pressure value in the boost cylinder and a comparing means for comparing the detected pressure in the injection cylinder and boost cylinder with the predetermined command pressure.

4. The injection control device of a die-casting machine according to claim 3, wherein the flow-rate control valve is a high-responsive electrohydraulic servovalve.

5. The injection control device of a die-casting machine according to claim 3, wherein the hydraulic discharging channel of the injection cylinder device and a hydraulic discharging channel from the boost cylinder device are connected.

6. The injection control device of a die-casting machine according to claim 3, the synchronous controller further comprising a pressure detector for detecting a casting pressure of the injection cylinder device, a pressure processor for processing an output from the pressure detecting means, a boost controller for outputting a command pressure value for every elapsed time according to a predetermined program, and a comparator for calculating a difference between a pressure outputted by the pressure processing means and a command pressure value outputted by the boost controller.

7. The injection control device of a die-casting machine according to claim 6, the synchronous controller further comprising a servo amplifier for controlling the flow-rate control valve so that a relationship between a casting pressure and boost time of the casting die changes in accordance with a selective curve along a predetermined critical boost curve for avoiding burr occurrence in die-casting products during the casting die during the boosting process by the boost cylinder device based on a difference outputted by the comparator.

8. The injection control device of a die-casting machine according to claim 3, further comprising a boost control valve for controlling boosting time on a hydraulic oil supply side of the boost cylinder.

9. The injection control device of a die-casting machine according to claim 8, the boost control valve further comprising a spool movable by operating a switching valve and an adjusting stopper for adjusting a moving amount of the spool, a distal end portion of the hydraulic oil supply side of the spool being tapered for narrowing the flow-rate of the hydraulic oil to regulate pressure and flow-rate of pressurizing portion of the boost piston.

10. The injection control device of a die-casting machine according to claim 3, wherein the synchronous controller controls the flow-rate control valve so that a relationship between a casting pressure and boost time of the casting die changes in accordance with along a selective curve along a predetermined critical boost curve for avoiding burr occurrences to the casting die during the synchronous controlling process.

11. The injection control device of a die-casting machine according to claim 10, the synchronous controller compares a detected pressure value detected by the injection cylinder device and the boost cylinder device and a command pressure value for every elapsed time given in accordance with a predetermined program and controls the flow-rate control valve to eliminate difference between the pressure values.

12. The injection control device of a die-casting machine according to claim 11, wherein the synchronous controller compares difference between the detected pressure value and the command pressure value and open-degree of the flow-rate control valve and controls the flow-rate control valve so that the open-degree corresponds to the difference.

13. The injection control device of a die-casting machine according to claim 3, wherein the flow control valve has a main spool to be opened and shut by a pilot servovalve.

14. The injection control device of a die-casting machine according to claim 13, further comprising a position sensor for detecting open-degree of the main spool.

15. The injection control device of a die-casting machine according to claim 14, wherein a command signal outputted by the position sensor and a difference between a command pressure value outputted by a boost controller and a detected pressure value detected by the injection cylinder device and the boost cylinder device are fed back to an input of the pilot servovalve.

* * * * *